US008480553B2

(12) United States Patent
Gerhard et al.

(10) Patent No.: US 8,480,553 B2
(45) Date of Patent: Jul. 9, 2013

(54) APPARATUS FOR LONGITUDINALLY FOLDING A MOVING MATERIAL WEB TWICE

(75) Inventors: Jakob Gerhard, Brittnau (CH); Martin Gfeller, Oftringen (CH)

(73) Assignee: Hunkeler AG, Wikon (CH)

( * ) Notice: Subject to any disclaimer, the term of this patent is extended or adjusted under 35 U.S.C. 154(b) by 249 days.

(21) Appl. No.: 13/067,179

(22) Filed: May 13, 2011

(65) Prior Publication Data

US 2011/0281707 A1 Nov. 17, 2011

(30) Foreign Application Priority Data

May 14, 2010 (CH) ..... 0755/10

(51) Int. Cl.
*B31F 1/00* (2006.01)

(52) U.S. Cl.
USPC ..... 493/438; 493/405; 493/446; 493/452

(58) Field of Classification Search
USPC ..... 493/438, 405, 446, 452, 455
See application file for complete search history.

(56) References Cited

U.S. PATENT DOCUMENTS

| | | | | |
|---|---|---|---|---|
| 3,165,310 | A * | 1/1965 | Peterson | 270/41 |
| 3,656,415 | A * | 4/1972 | Hook, Jr. | 493/196 |
| 3,683,755 | A * | 8/1972 | Lattke | 493/123 |
| 4,502,675 | A * | 3/1985 | Clark et al. | 270/40 |
| 4,538,517 | A | 9/1985 | Michalik et al. | |
| 4,591,354 | A * | 5/1986 | Gelbard | 493/439 |
| 5,007,890 | A | 4/1991 | Alverth et al. | |
| 5,230,501 | A | 7/1993 | Melton | |
| 5,486,152 | A * | 1/1996 | Heinz et al. | 493/468 |
| 5,938,143 | A | 8/1999 | Yukitake | |
| 6,740,021 | B2 * | 5/2004 | Evans et al. | 493/405 |
| 2004/0185995 | A1 | 9/2004 | Hoffmann et al. | |

FOREIGN PATENT DOCUMENTS

| | | |
|---|---|---|
| AU | 459861 | 4/1971 |
| DE | 208 548 | 4/1909 |
| DE | 2 503 701 | 8/1976 |
| EP | 0 107 126 | 10/1983 |
| EP | 1 460 014 A1 | 9/2004 |
| EP | 2 123 585 A1 | 11/2009 |
| GB | 1 418 347 | 12/1975 |

OTHER PUBLICATIONS

Jul. 8, 2010 Search Report issued in Swiss Patent Application No. CH00755/10, with translation.

* cited by examiner

*Primary Examiner* — Hemant M Desai
(74) *Attorney, Agent, or Firm* — Oliff & Berridge, PLC

(57) ABSTRACT

In order to form two longitudinal folds in a material web, there are two plow folding units which extend in the vertical direction and are arranged behind one another in the movement direction of the material web. Each of the plow folding units has two guide elements for the material web, which guide elements are arranged in the manner of a gable or saddle roof. The guide elements are arranged behind one another in the movement direction of the material web and enclose a folding angle between them. The folding angle between the guide elements of the second plow folding unit which is arranged downstream of the first plow folding unit has a magnitude of at least 100°, preferably of at least 140°.

9 Claims, 2 Drawing Sheets

1
2
3
4
5
6
7
8
9
10
11
12
13
14
15
16
17
18
19
20
21
22
23
21'
22'
23'
α1
α2
A
H
V

APPARATUS FOR LONGITUDINALLY FOLDING A MOVING MATERIAL WEB TWICE

CROSS-REFERENCE TO RELATED APPLICATION

This application claims priority from Swiss Patent Application No. 2010 0755/10, filed May 14, 2010, the entire disclosure of which is incorporated herein by reference.

BACKGROUND

The present invention relates to an apparatus for longitudinally folding a moving material web twice.

BRIEF DESCRIPTION OF THE DRAWINGS

In the following text, one exemplary embodiment of the subject matter of the invention will be explained in greater detail using the drawings, in which, purely diagrammatically.

DETAILED DESCRIPTION OF EMBODIMENTS

Figure 1:
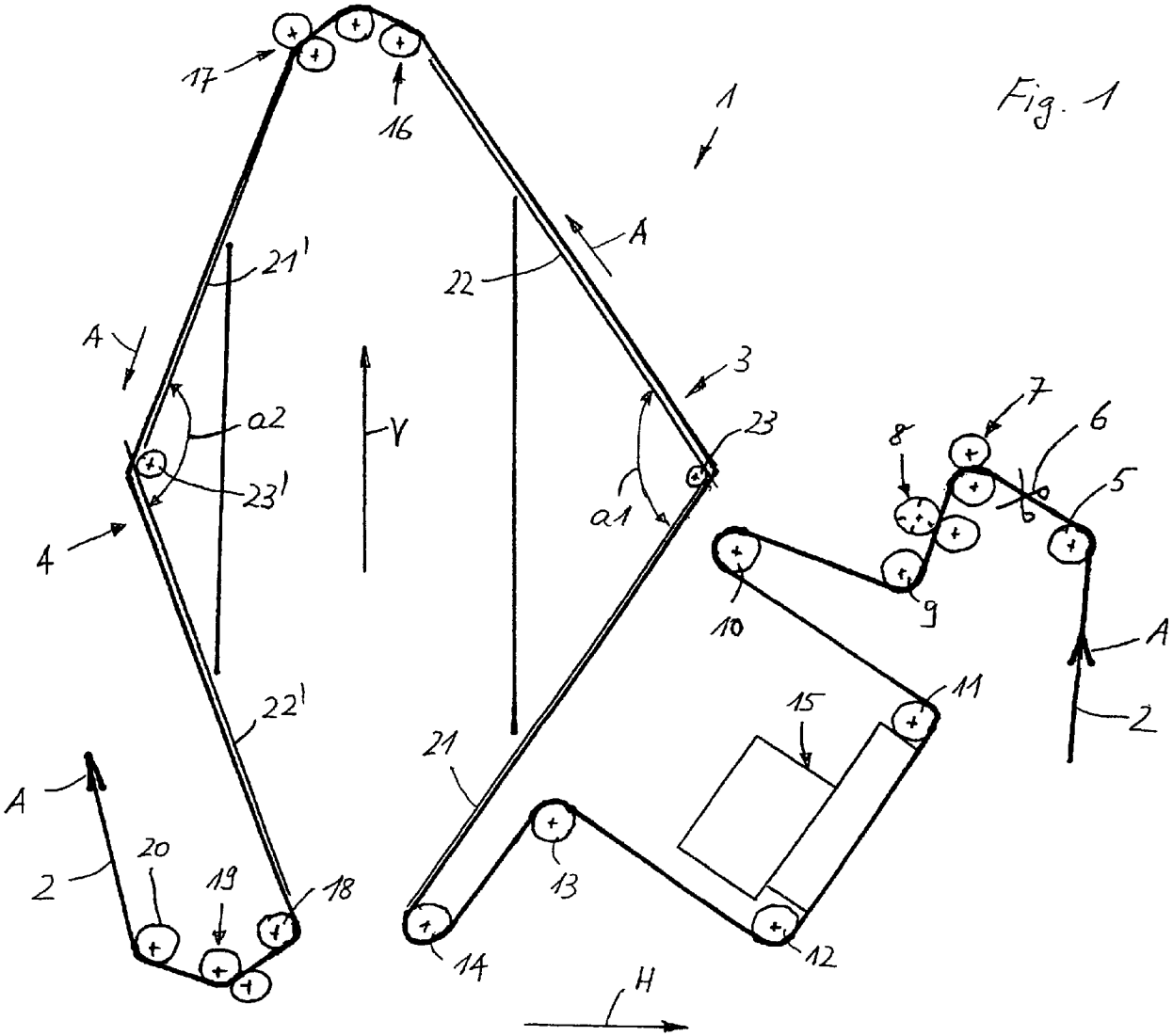
FIG. 1 shows an apparatus for longitudinally folding a moving material web twice, in side view.

The longitudinal folding apparatus 1 shown in side view in FIG. 1 serves to longitudinally fold a material web 2 twice, which material web 2 is moved through the longitudinal folding apparatus 1 in the direction of the arrows A. The longitudinal folding apparatus 1 has two plow folding units 3 and 4 which are arranged behind one another in the movement direction A of the material web 2. The two plow folding units 3 and 4 are arranged substantially in the direction of the vertical (represented by the arrow V). That is to say, the plow folding units 3 and 4 are arranged at an angle to the horizontal (represented by the arrow H), said angle being 90° in the exemplary embodiment shown. However, said angle can also be less than 90° . In this case, the plow folding units 3, 4 are inclined with respect to the vertical V. The more precise design of the plow folding units 3 and 4, of which each corresponds substantially to the plow folding unit shown in EP-A-2 123 585 (FIGS. 1 and 2), will be explained in greater detail in the following text using FIGS. 2 and 3.

The material web 2 which runs into the longitudinal folding apparatus 1 is first of all guided over a deflecting roller 5 and subsequently runs through a slitting arrangement 6 (shown only diagrammatically) which serves to cut away edge sections of the material web 2. A first drive arrangement 7 for the material web 2 is arranged behind said slitting arrangement 6, which first drive arrangement 7 is followed by a perforating unit 8 which serves to perforate the material web 2 along the future folding lines to be provided. Instead of the perforating unit 8, a scoring unit can also be provided which produces a crease in the material web 2, which crease runs along the folding lines provided. Behind the perforating unit 8, the material web 2 is guided over a number of deflecting rollers, over the deflecting rollers 9, 10, 11, 12, 13 and 14 in the exemplary embodiment which is shown. A web edge controller 16 which is known per se for regulating the run of the material web 2 is arranged between the deflecting rollers 11 and 12. The material web 2 which is deflected around the deflecting roller 14 is folded once in its longitudinal direction in the first plow folding unit 3. The folded material web 2 is then guided over a deflecting arrangement 16 and is driven by means of a second drive arrangement 17 which is arranged between the first plow folding unit 3 and the second plow folding unit 4. The material web 2 is folded a second time in its longitudinal direction in the second plow folding arrangement 4. The material web 2 which has been folded twice is guided around a deflecting roller 18 and is driven by means of a third drive arrangement 19. The material web 2 which has been folded twice is guided around a deflecting roller 20 behind the third drive arrangement 19 and leaves the longitudinal folding apparatus 1 for further processing in the following processing unit.

Figure 2:
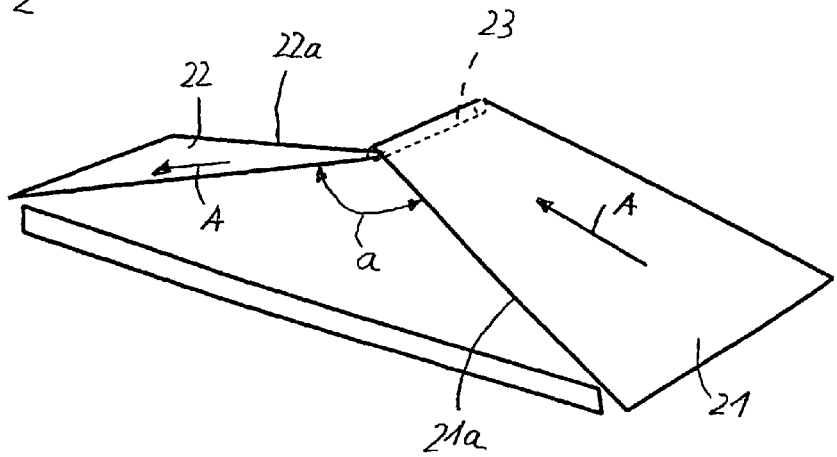
FIG. 2 shows a perspective view of one of the plow folding units of the apparatus which is shown in FIG. 1.
Figure 3:
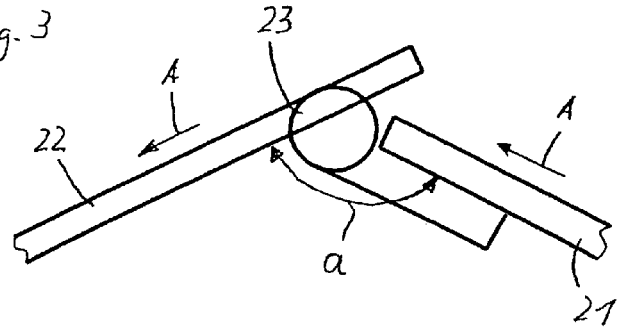
FIG. 3 shows a side view of the web deflecting region of the plow folding unit according to FIG. 2.

In the following text, the construction of the plow folding units 3 and 4 will now be described with reference to FIGS. 2 and 3.

The two plow folding units 3, 4 are in principle of identical construction and differ in the exemplary embodiment which is shown only as a result of the magnitude of the folding angle a, as will still be explained. Each plow folding unit 3, 4 has two guide elements 21, 22 or 21', 22' (FIG. 1), over which the material web 2 is guided. Each guide element 21, 22 has a folding edge 21*a* or 22*a* (FIG. 2) which extends in the movement direction A of the material web 2, but runs obliquely with regard to said movement direction A. The two guide elements 21, 22 or 21', 22' are arranged in the manner of a gable or saddle roof behind one another in the movement direction A of the material web 2 and enclose a folding angle a or a1, a2 (FIG. 1) between them. A deflecting element 23 or 23' (FIG. 1) is arranged at the transition from the first guide element 21 or 21' to the second guide element 22 or 22'.

As already mentioned, in the exemplary embodiment which is shown, the magnitude of the folding angle a1 between the guide elements 21, 22 of the first plow folding unit 3 differs from the magnitude of the folding angle a2 between the guide elements 21', 22' of the other, second plow folding unit 4. Here, the folding angle a1 of the first plow folding unit 3 is smaller than the folding angle a2 of the second plow folding unit 4. In certain cases, the two folding angles a1 and a2 can also be equally large, however. It is important, however, that the folding angle a2 of the second plow folding unit 4 has a minimum magnitude of at least 100°, preferably a minimum magnitude of 140°, in order that the second longitudinal fold can be formed satisfactorily on the material web 2 which has already been folded once.

A passage is provided between the guide elements 21, 22 or 21', 22', through which passage that web section of the material web 2 which has been folded over respectively is guided.

The method of operation of the longitudinal folding apparatus 1 is as follows:

The material web 2 is pulled into the longitudinal folding apparatus 1 by means of the first drive arrangement 7 and runs through the slitting arrangement 6 and the perforating unit 8 before it is pulled over the guide elements 21, 22 of the first plow folding unit 3. In said first plow folding unit 3, the formation of the first longitudinal fold in the material web 2 takes place in a manner known per se by folding over a section of the material web 2 along the folding edges 21*a*, 22*a* of the guide elements 21, 22. The web tension which is required for the folding operation is produced by the first drive arrangement 7 and the second drive arrangement 17. The material web 2 which has been folded once and is deflected by means of the deflecting arrangement 16 is pulled by the third drive arrangement 19 over the folding elements 21', 22' of the second plow folding unit 4, in which the second longitudinal fold is formed in the material web 2 in the way which has already been described. The web tension which is required for this is produced by the second drive arrangement 17 and the third drive arrangement 19. The fact that the folding angle a2 of the second plow folding unit 4 is at least 100°, preferably 140°, ensures that a satisfactory second longitudinal fold is formed in the material web 2 which has already been folded once.

The vertical arrangement of the two plow folding units 3, 4 has the advantage of a space-saving design of the longitudinal folding apparatus 1. If the plow folding units 3, 4 are arranged in such a way that they are inclined with respect to the vertical V, this leads to a larger overall length of the longitudinal folding apparatus 1.

What is claimed is:

1. An apparatus for longitudinally folding a moving material web twice, wherein two plow folding units are provided which are arranged behind one another in the movement direction of the material web, each plow folding unit has two guide elements for the material web, which guide elements are arranged in the manner of a gable or saddle roof, are arranged behind one another in the movement direction of the material web and enclose a folding angle between them, the folding angle between the guide elements of the second plow folding unit which is arranged behind the first plow folding unit having a magnitude of at least 100°.

2. The apparatus as claimed in claim 1, wherein the folding angle between the guide elements of the second plow folding unit has a magnitude of at least 140°.

3. The apparatus as claimed in claim 1, wherein the magnitude of the folding angle between the guide elements of the one, first plow folding unit differs from the magnitude of the folding angle between the guide elements of the other, second plow folding unit.

4. The apparatus as claimed in claim 3, wherein the folding angle between the guide elements of the first plow folding unit is smaller than the folding angle between the guide elements of the second plow folding unit.

5. The apparatus as claimed in claim 1, wherein the guide elements are provided with a folding edge which extends in the movement direction of the material web and runs obliquely with regard to said movement direction.

6. The apparatus as claimed in claim 1, wherein the plow folding units are arranged at an angle to the horizontal, and in that a deflecting arrangement for the material web is provided between the plow folding units.

7. The apparatus as claimed in claim 6, wherein the two plow folding units are arranged substantially vertically.

8. The apparatus as claimed in claim 1, wherein a first drive arrangement for the material web is arranged in front of the first plow folding unit, a second drive arrangement for the material web is arranged between the two plow folding units, and a third drive arrangement for the material web is arranged downstream of the second plow folding unit, a tensile stress being produced in the material web which runs through the first plow folding unit by means of the first and second drive arrangements, and a tensile stress being produced in the material web which runs through the second plow folding unit by means of the second and third drive arrangements.

9. The apparatus as claimed in claim 1, wherein a perforating or scoring unit is arranged in upstream of the first plow folding unit for perforating or scoring the material web along the future folding lines to be provided.

* * * * *